US010954041B1

(12) United States Patent
Wilson-Turnbow

(10) Patent No.: US 10,954,041 B1
(45) Date of Patent: Mar. 23, 2021

(54) SELECTABLY SECURABLE CONTAINER LID

(71) Applicant: Jaidah Wilson-Turnbow, Chicago, IL (US)

(72) Inventor: Jaidah Wilson-Turnbow, Chicago, IL (US)

( * ) Notice: Subject to any disclaimer, the term of this patent is extended or adjusted under 35 U.S.C. 154(b) by 0 days.

(21) Appl. No.: 16/910,036

(22) Filed: Jun. 23, 2020

(51) Int. Cl.
*B65D 43/02* (2006.01)
*A47G 19/22* (2006.01)

(52) U.S. Cl.
CPC ..... *B65D 43/0222* (2013.01); *A47G 19/2205* (2013.01); *B65D 2251/08* (2013.01); *B65D 2543/00092* (2013.01)

(58) Field of Classification Search
CPC ..... B65D 43/0222; B65D 2543/00092; B65D 2251/08; A47G 19/2205
USPC ..... 220/287, 578, 579, 799, 800, 826; 215/246
See application file for complete search history.

(56) References Cited

U.S. PATENT DOCUMENTS 2,713,436 A * 7/1955 Hirschberg ..... B65D 53/06 215/231
2,955,722 A * 10/1960 Autonious ..... A47G 23/03 215/393
3,141,567 A * 7/1964 Schearer ..... B65D 43/0214 220/287
3,157,304 A * 11/1964 Judge ..... B65D 43/0218 215/318
3,310,334 A * 3/1967 Murphy ..... B65D 71/406 294/87.28
3,655,089 A * 4/1972 Tower ..... B65D 43/0218 220/287
4,955,500 A * 9/1990 Rhoads ..... B44D 3/127 220/212
4,969,570 A * 11/1990 Harvey, Sr. ..... B65D 25/20 220/733
5,123,565 A * 6/1992 Majewski ..... B44D 3/128 220/287
5,497,898 A * 3/1996 Perez ..... B65D 43/022 206/308.1
5,577,539 A * 11/1996 Shaw ..... B67C 11/02 141/106
2010/0237077 A1* 9/2010 Hughes ..... A47G 19/2211 220/323
2017/0297791 A1* 10/2017 VanGordon ..... B65D 75/002

* cited by examiner

*Primary Examiner* — James N Smalley
(74) *Attorney, Agent, or Firm* — The Keys Law Firm PLLC

(57) ABSTRACT

A selectably securable container lid that is selectively attachable to different sized rims of different cups, having a circular body, a central aperture which passes through the body, a perimeter edge, a top side, and a bottom side. The top side may include a diametral valley and the bottom side may include a plurality of radially disposed securing nubs. The selectably securable container lid may be frictionally secured to the rim of a cup through the application of mechanical force that presses the selectably securable container lid into the rim, and may be later removed from the cup by lifting from an edge of the selectably securable container lid sufficiently to dislodge the friction fit.

16 Claims, 5 Drawing Sheets

SELECTABLY SECURABLE CONTAINER LID

BACKGROUND OF THE INVENTION

Field of the Invention

This invention relates generally to a removable cover for a container and, more particularly, to a lid having a set of securing nubs which are arranged to allow the lid to be removably and selectively attached to different sized rims on open top containers.

Description of the Prior Art

The use and design of open top containers, particularly cups, to hold and pour liquids or solids is well established. Cups can be made of glass, metal, china, clay, wood, stone, polystyrene, plastic, aluminum or other materials and may be formed in many different styles and with or without varying adornments.

The portion surrounding the open top of a cup is generally referred to as a rim. Because the rim is typically just the upper edge of the sides of a cup, the size of the rim generally will correspond to the size of the cup, particularly its circumference. Because cups come in many different shapes and sizes, a problem which exists is that because different size lids are typically required for different sized cups, if a user does not have a specific lid that is sized for a specific cup, the user is not able to cover the cup when desired.

As such, there remains a need for a selectably securable container lid that includes a plurality of securing nubs extending from its bottom surface which allowed the lid to be selectively attached to the rim of different sized cups. It would be advantageous if such a selectably securable container lid was structured with the securing nubs that arranged in a radial grid. It would additionally be desirable for such a selectably securable container lid to include an diametral valley extending across its top surface which allowed for easy placement and removal thereof.

SUMMARY OF THE INVENTION

The present disclosure provides for a selectably securable container lid selectively attachable to the rim of a cup, comprising: a body having a body having central aperture which passes through the body and a perimeter edge, wherein the body includes a top side and a bottom side; wherein the top side includes a substantially top planar surface and has an elongated valley which forms a recess in the planar top surface; wherein the bottom side includes a substantially planar bottom surface that includes a plurality of securing nubs which each extend separately from the planar bottom surface; and wherein the plurality of securing nubs extend from a location adjacent to the central aperture to a location adjacent to the perimeter edge.

DETAILED DESCRIPTION OF THE INVENTION

Described herein is a selectably securable container lid that is selectively attachable to different sized rims of different cups. The selectably securable container lid may be frictionally secured to the rim of a cup through the application of mechanical force that presses the selectably securable container lid into the rim, and may be later removed from the cup by lifting from an edge of the selectably securable container lid sufficiently to dislodge the friction fit.

Figure 1:
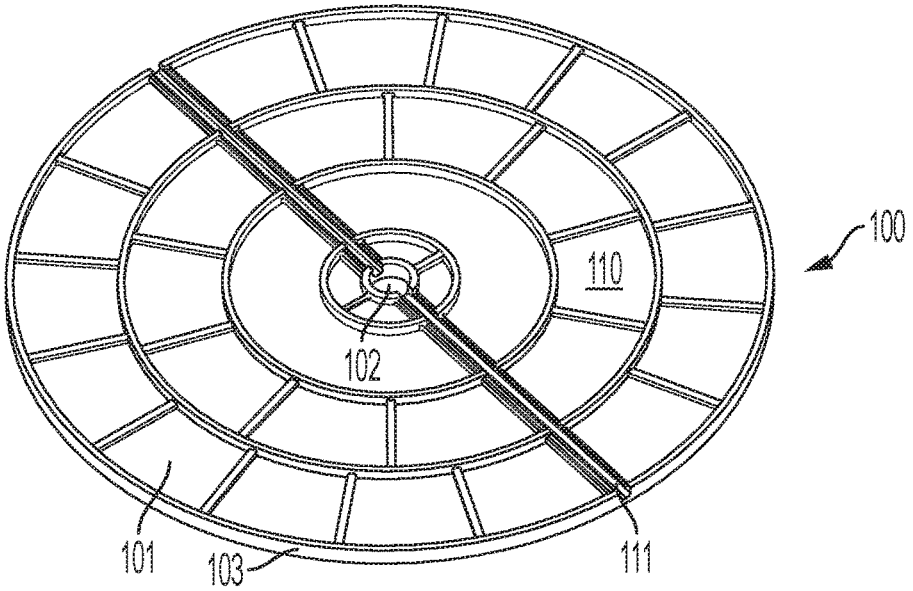
FIG. 1 is a top perspective view of a selectably securable container lid built in accordance with a large embodiment of the present invention.
Figure 2:
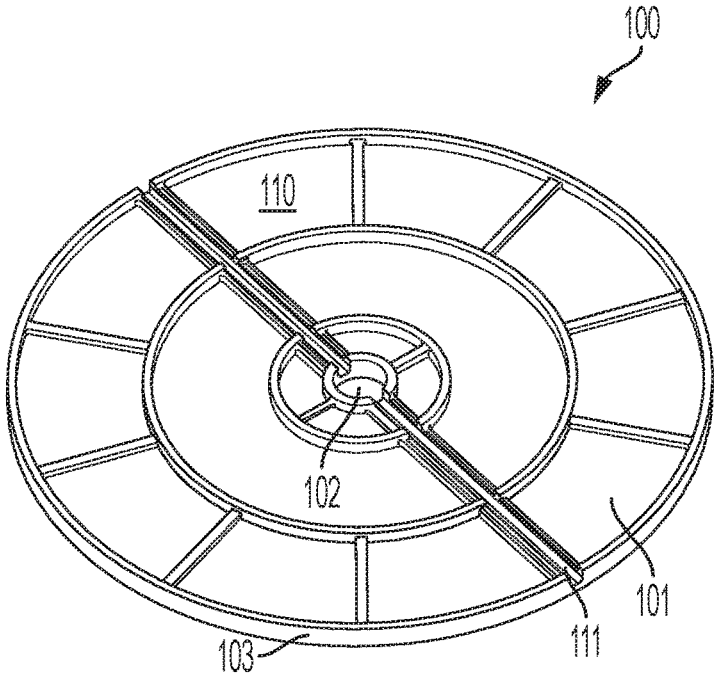
FIG. 2 is a top perspective view of a selectably securable container lid built in accordance with a medium embodiment of the present invention.
Figure 3:
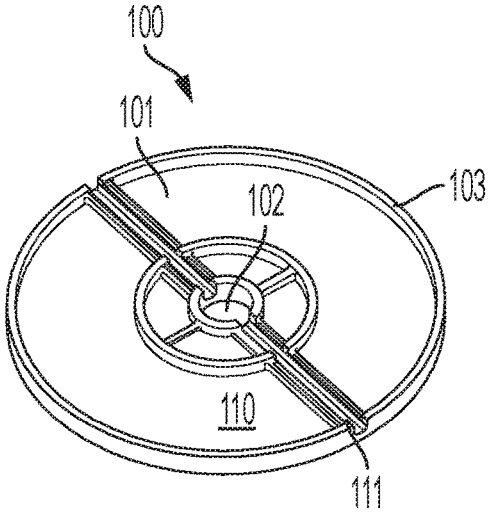
FIG. 3 is a top perspective view of a selectably securable container lid built in accordance with a small embodiment of the present invention.
Figure 4:
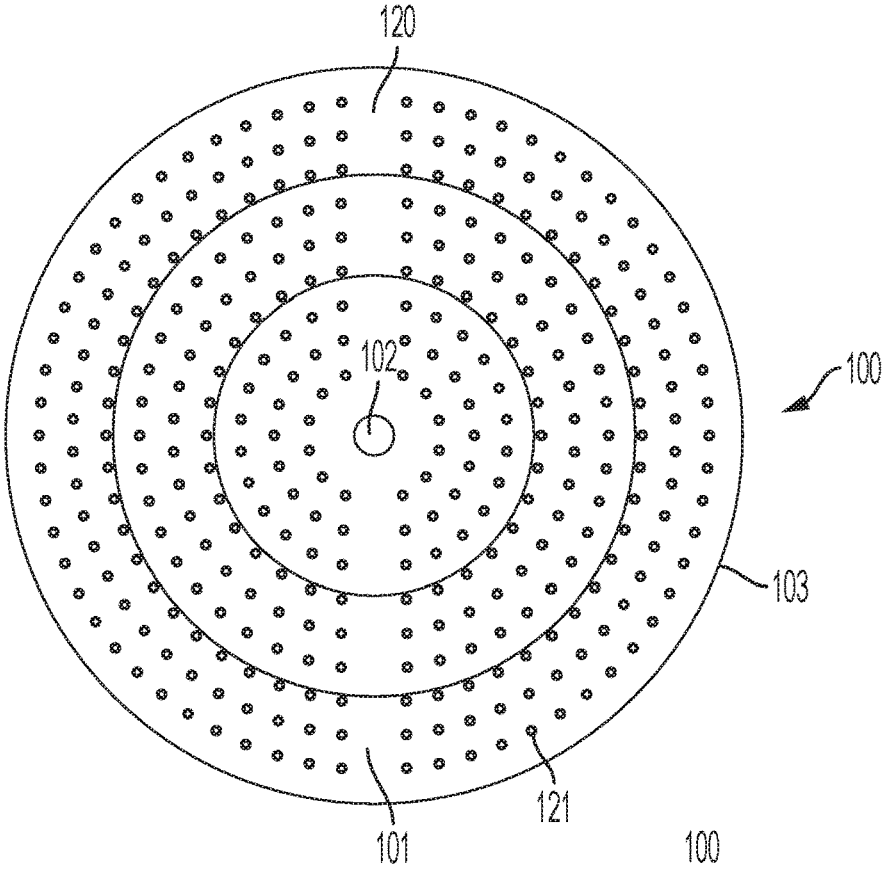
FIG. 4 is a bottom plan view of a selectably securable container lid built in accordance with a large embodiment of the present invention.
Figure 5:
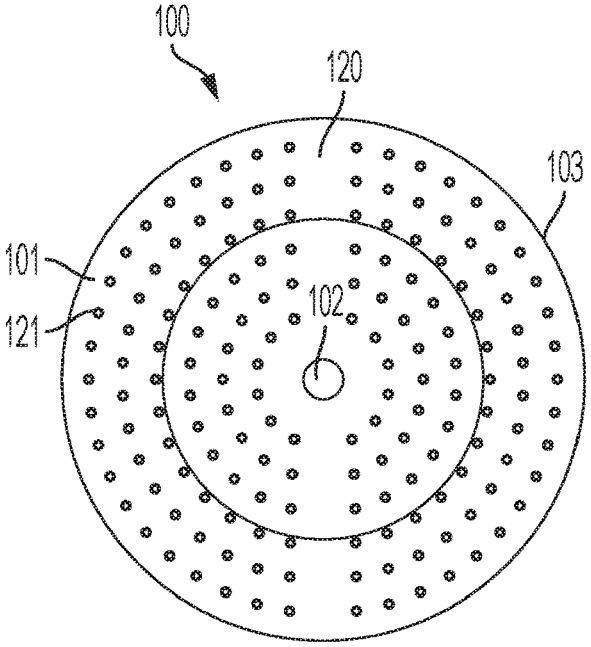
FIG. 5 is a bottom plan view of a selectably securable container lid built in accordance with a medium embodiment of the present invention.
Figure 6:
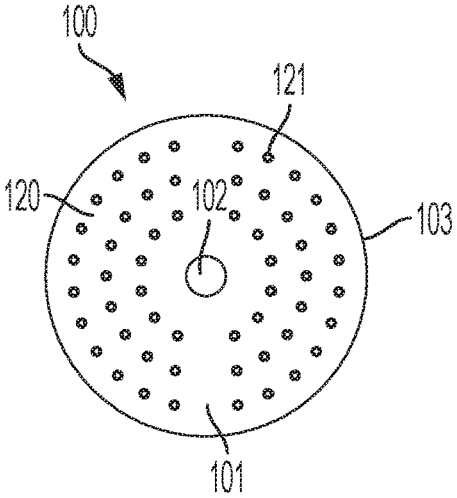
FIG. 6 is a bottom plan view of a selectably securable container lid built in accordance with a small embodiment of the present invention.
Figure 7:
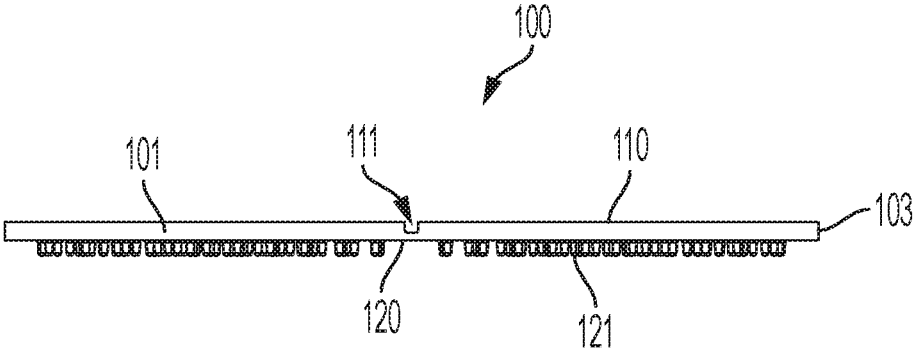
FIG. 7 is a side elevational view of a selectably securable container lid built in accordance with a large embodiment of the present invention.
Figure 8:
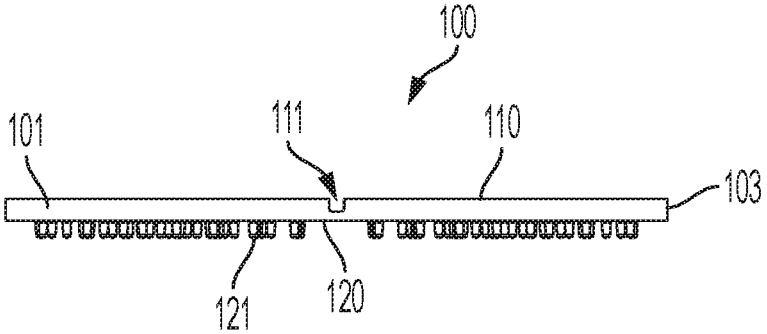
FIG. 8 is a side elevational view of a selectably securable container lid built in accordance with a medium embodiment of the present invention.
Figure 9:
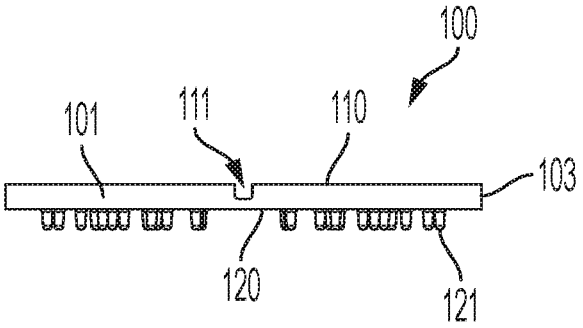
FIG. 9 is a side elevational view of a selectably securable container lid built in accordance with a small embodiment of the present invention.

Referring now to the drawings and, in particular, FIGS. 1, 2, 3, 4, 5, 6, 7, 8, and 9, a selectably securable container lid 100 built in accordance with embodiments of the present invention is shown having a circular, disc shaped body 101 that includes a central aperture 102 extending through it, a perimeter edge 103, a top side 110 and a bottom side 120. The circular body 101 may be a molded one piece member that is constructed of rubber, a resilient plastic, or other resilient material.

The top side 110 may be defined by a substantially planar surface and includes a diametral valley 111 forming a recess in the planar surface which extends out from opposing sides of the central aperture 102 so that the diametral valley 111 combined with the central aperture 102 extends completely across the entire circular body 101. The top side 110 may additionally include printed indicia that is raised from the surface and one or a plurality of arcuate or straight ridges that are raised from the surface.

The bottom side 120 may be defined by a substantially planar surface that includes a plurality of securing nubs 121, positioned to radially extend out from a location adjacent to the central aperture 102 to a location adjacent to the perimeter edge 103 of the circular body 101. It is contemplated, however, that the securing nubs 121 may be positioned so that none are located on the portion of the bottom side 120 that is beneath or otherwise opposite the diametral valley 111.

It is contemplated that securing nubs 121 may be arranged in a plurality of circular sets, with each circular set containing securing nubs 121 that are substantially the same distance from the central aperture 102 and with each circular set having progressively more securing nubs 121 than every circular set that is closer to the central aperture 102.

It is additionally contemplated that the securing nubs 121 in adjacent circular sets may be positioned such that the rim of a cup (or other open top container) can frictionally fit in between on the securing nubs 121 in adjacent circular sets. As such, the selectably securable container lid 100 may be secured to a cup whose rim can be positioned between the securing nubs 121 in adjacent circular sets.

Figure 10:
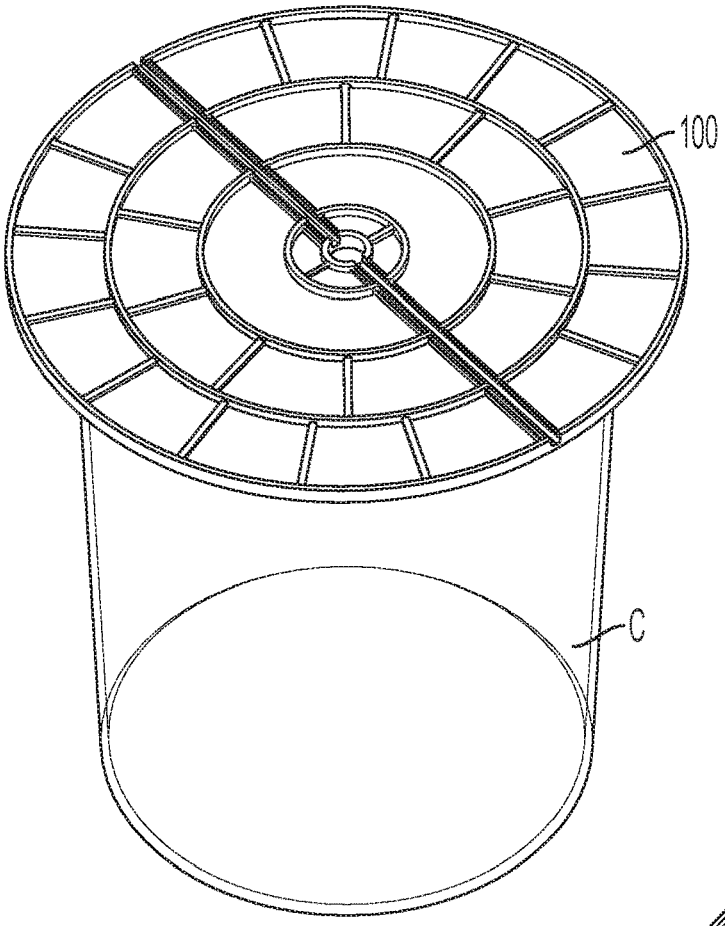
FIG. 10 is a top perspective view of a selectably securable container lid built in accordance with a large embodiment of the present invention, shown in place on a large cup.
Figure 11:
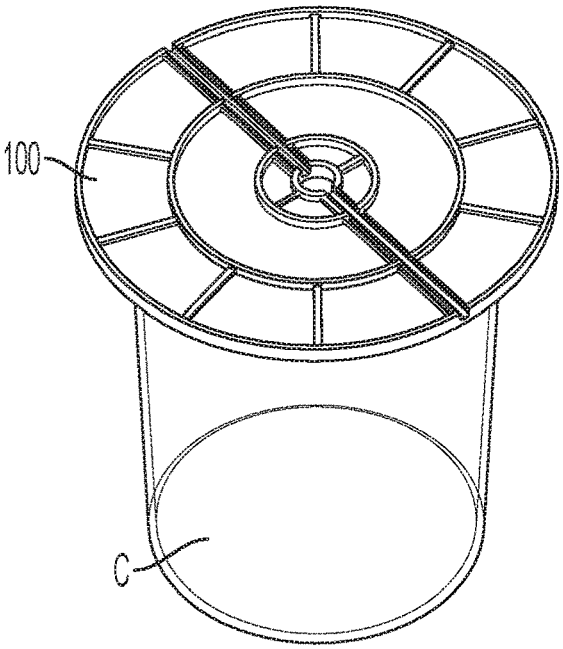
FIG. 11 is a top perspective view of a selectably securable container lid built in accordance with a medium embodiment of the present invention, shown in place on a medium cup.
Figure 12:
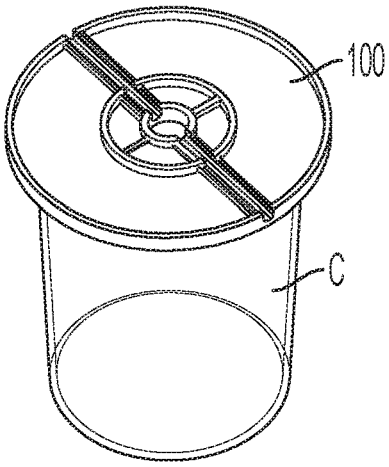
FIG. 12 is a top perspective view of a selectably securable container lid built in accordance with a small embodiment of the present invention, shown in place on a small cup.
Figure 13:
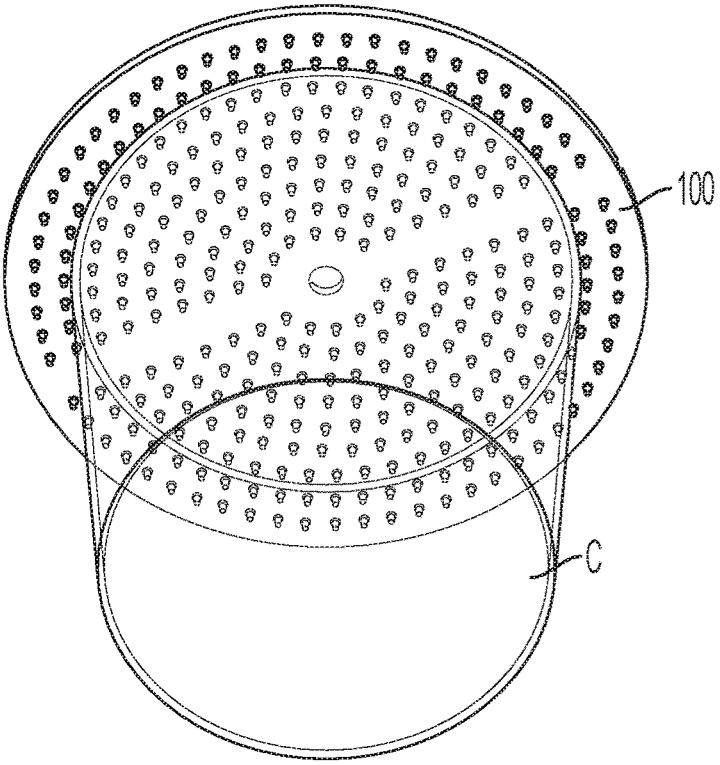
FIG. 13 is a bottom perspective view of a selectably securable container lid built in accordance with a large embodiment of the present invention, shown in place on a large cup.
Figure 14:
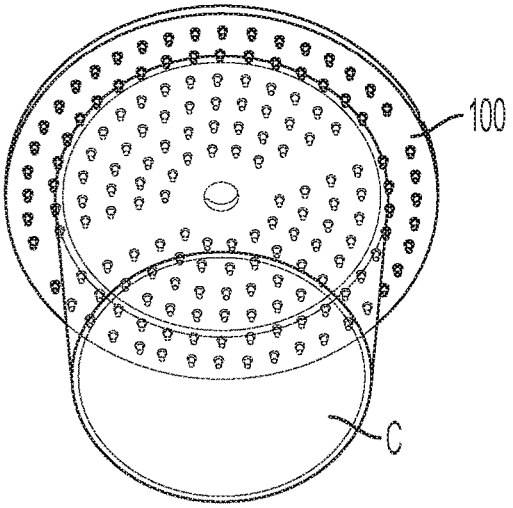
FIG. 14 is a bottom perspective view of a selectably securable container lid built in accordance with a medium embodiment of the present invention, shown in place on a medium cup.
Figure 15:
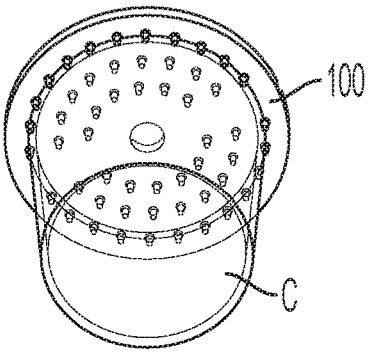
FIG. 15 is a bottom perspective view of a selectably securable container lid built in accordance with a small embodiment of the present invention, shown in place on a small cup.

Referring now to FIGS. 1, 2, 3, 4, 5, 6, 7, 8, 9, 10, 11, 12, 13, 14, and 15, in use, the selectably securable container lid 100 may be secured to a cup C by positioning its bottom side 120 against a rim of the cup C and then applying downward mechanical force to force the securing nubs 121 in adjacent circular sets around the rim the cup C, thereby creating a frictional attachment. Because there are many potential adjacent circular sets of varying circumferences, the selectably securable container lid 100 of a single given size may be used with a wide variety of cup sizes.

When it is desired to remove the selectably securable container lid 100 from a cup C, mechanical force sufficient to dislodge the frictional bond between securing nubs 121 and the rim of the cup C may be applied in an upward direction (away from the cup C) on the perimeter edge 103. It is contemplated that the ideal portion of the perimeter edge 103 to apply the force is the portion furthest from the ends of the diametral valley 111. The application of such a force will cause the rim to be dislodged from the securing nubs 121 beginning at the location closest to the area of the perimeter edge 103 being lifted, and continuing progressively around the rim as the perimeter edge 103 continues to be lifted. If the portion of the perimeter edge 103 furthest from the diametral valley 111 is used to apply the force, once the securable container lid 100 is halfway off, it can bend at the diametral valley 111 and provide greater leverage to continue to remove the selectably securable container lid 100 from the rim.

It is contemplated that the selectably securable container lid 100 may be provided in a large size embodiment, as shown in FIGS. 1, 4, 7, 10, and 13, a medium sized embodiment, as shown in FIGS. 2, 4, 8, 11, and 14, and a small size embodiment, as shown in FIGS. 3, 6, 9, 12, and 15.

It is appreciated that the central aperture 102 may, when the selectably securable container lid is positioned on a cup C, allow items to be inserted through the selectably securable container lid 100 into the cup C.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A selectably securable container lid for removably attaching to a cup, comprising:

a body having central aperture which passes through the body and a perimeter edge, wherein the body includes a top side and a bottom side;

wherein the topside includes a substantially top planar surface and has an elongated valley which forms a uniform recess in the planar top surface;

wherein the elongated valley extends out from opposing sides of the central aperture and, together with the central aperture, extends completely across the top side;

wherein the bottom side includes a substantially planar bottom surface that includes a partitioning portion that runs beneath the entire elongated valley as well as a plurality of securing nubs which each extend separately from the planar bottom surface and are arranged in a plurality of circular sets, with each of the plurality of circular sets having several of the plurality of securing nubs which are substantially the same distance from the central aperture;

wherein none of the plurality of securing nubs are positioned on the partitioning portion, forming a partition space that, for each of the plurality of circular sets, separates a first securing nub among the plurality of securing nubs that is next to the partitioning portion from a second securing nub among the plurality of securing nubs that is closest to the first securing nub but on the opposing side of the partitioning portion an amount which is greater than an adjacent space present between at least one pair of securing nubs among the plurality of securing nubs which are in the same circular set, next to one another, and on the same side of the partitioning portion; and wherein the plurality of circular sets are each positioned to allow a target rim of a target open top container to frictionally fit in between the plurality of securing nubs of two of the plurality of circular sets which are adjacent to each other, thereby enabling the bottom side of the body to be removably and repeatably secured to the target open top container without altering the target open top container.

2. The selectably securable container lid for removably attaching to a cup of claim 1, wherein said body is a molded one piece member.

3. The selectably securable container lid for removably attaching to a cup of claim 1, wherein the elongated valley extends out radially from opposing sides of the central aperture.

4. The selectably securable container lid for removably attaching to a cup of claim 1, wherein none of the plurality of securing nubs are positioned on the bottom side beneath the elongated valley.

5. The selectably securable container lid for removably attaching to a cup of claim 1, wherein the body has a circular shape.

6. The selectably securable container lid for removably attaching to a cup of claim 5, wherein the plurality of securing nubs, relative to the central aperture, are spread across the bottom side in a radial pattern, with each of the plurality of circular sets having progressively more of the plurality of securing nubs than every other one of the plurality of circular sets that is closer to the central aperture.

7. The selectably securable container lid for removably attaching to a cup of claim 1, wherein the bottom side of the body is configured to be selectively secured to any of a plurality of discrete open top containers whose rim circumference is less than a circumference of an outer set among the plurality of circular sets that is closest to the perimeter edge and greater than a circumference of an inner set among the plurality of circular sets that is closest to the central aperture.

8. The selectably securable container lid for removably attaching to a cup of claim 1, wherein the plurality of securing nubs, relative to the central aperture, are spread across the bottom side in a radial pattern, with each of the plurality of circular sets having progressively more of the plurality of securing nubs than every other one of the plurality of circular sets that is closer to the central aperture.

9. A selectably securable container lid for removably attaching to a cup, comprising:

a body having a circular shape, a central aperture which passes through the body, and a perimeter edge, wherein the body includes a top side and a bottom side;

wherein the topside includes a substantially top planar surface and has an elongated valley which forms a uniform recess in the planar top surface;

wherein the elongated valley extends out radially from opposing sides of the central aperture;

wherein the bottom side includes a substantially planar bottom surface that includes a partitioning portion that runs beneath the entire elongated valley as well as a plurality of securing nubs which each extend separately from the planar bottom surface and are arranged in a plurality of circular sets, with each of the plurality of circular sets having several of the plurality of securing nubs which are substantially the same distance from the central aperture;

wherein the plurality of securing nubs, relative to the central aperture, are spread across the bottom side in a radial pattern, with each of the plurality of circular sets having progressively more of the plurality of securing nubs than every other one of the plurality of circular sets that is closer to the central aperture, such that the plurality of circular sets are each positioned to allow a target rim of a target open top container to frictionally fit in between the plurality of securing nubs of two of the plurality of circular sets which are adjacent to each other, thereby enabling the bottom side of the body to be secured to the target open top container without altering the target open top container; and wherein none of the plurality of securing nubs are positioned on the partitioning portion, forming a partition space that, for each of the plurality of circular sets, separates a first securing nub among the plurality of securing nubs that is next to the partitioning portion from a second securing nub among the plurality of securing nubs that is closest to the first securing nub but on the opposing side of the partitioning portion an amount which is greater than an adjacent space present between at least one pair of securing nubs among the plurality of securing nubs which are in the same circular set, next to one another, and on the same side of the partitioning portion.

10. The selectably securable container lid for removably attaching to a cup of claim 9, wherein said body is a molded one piece member.

11. The selectably securable container lid for removably attaching to a cup of claim 9, wherein the elongated valley together with the central aperture extends completely across the entire circular body.

12. The selectably securable container lid for removably attaching to a cup of claim 11, wherein none of the plurality of securing nubs are positioned on the bottom side beneath the elongated valley.

13. The selectably securable container lid for removably attaching to a cup of claim 9, wherein none of the plurality of securing nubs are positioned on the bottom side beneath the elongated valley.

14. The selectably securable container lid for removably attaching to a cup of claim 9, wherein the bottom side of the body is configured to be selectively secured to any one of a plurality of discrete open top containers whose rim circumference is less than a circumference of an outer set among the plurality of circular sets that is closest to the perimeter edge and greater than a circumference of an inner set among the plurality of circular sets that is closest to the central aperture.

15. A selectably securable container lid for removably attaching to a cup, comprising:

a body having a circular shape, a central aperture which passes through the body, and a perimeter edge, wherein the body includes a top side and a bottom side;

wherein the topside includes a substantially top planar surface and has an elongated valley which forms a uniform recess in the planar top surface;

wherein the elongated valley extends out radially from opposing sides of the central aperture and together with the central aperture extends completely across the entire circular body;

wherein the bottom side includes a substantially planar bottom surface that includes a partitioning portion that runs beneath the entire elongated valley as well as a plurality of securing nubs which each extend separately from the planar bottom surface and are arranged in a plurality of circular sets, with each of the plurality of circular sets having several of the plurality of securing nubs which are substantially the same distance from the central aperture;

wherein the plurality of securing nubs, relative to the central aperture, are spread across the bottom side in a radial pattern, with each of the plurality of circular sets having progressively more of the plurality of securing nubs than every other one of the plurality of circular sets that is closer to the central aperture, such that the plurality of circular sets are each positioned to allow a target rim of a target open top container to frictionally fit in between the plurality of securing nubs of two of the plurality of circular sets which are adjacent to each other, thereby enabling the bottom side of the body to be secured to the target open top container without altering the target open top container;

wherein none of the plurality of securing nubs are positioned on the partitioning portion, forming a partition space that, for each of the plurality of circular sets, separates a first securing nub among the plurality of securing nubs that is next to the partitioning portion from a second securing nub among the plurality of securing nubs that is closest to the first securing nub but on the opposing side of the partitioning portion an amount which is greater than an adjacent space present between at least one pair of securing nubs among the plurality of securing nubs which are in the same circular set, next to one another, and on the same side of the partitioning portion, thereby enabling thereby enabling the bottom side of the body, once secured to the target open top container, to be removed without altering the target open top container; and wherein the bottom side of the body is configured to be selectively secured to any one of a plurality of discrete open top containers whose rim circumference is less than a circumference of an outer set among the plurality of circular sets that is closest to the perimeter edge and greater than a circumference of an inner set among the plurality of circular sets that is closest to the central aperture.

16. The selectably securable container lid for removably attaching to a cup of claim 15, wherein said body is a molded one piece member.

* * * * *